US006470862B2

(12) United States Patent
Isobe et al.

(10) Patent No.: US 6,470,862 B2
(45) Date of Patent: Oct. 29, 2002

(54) EVAPORATED FUEL PROCESSING SYSTEM

(75) Inventors: Takashi Isobe; Manabu Niki; Takashi Iwamoto; Hiroyuki Ando; Kojiro Tsutsumi, all of Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/773,011

(22) Filed: Jan. 31, 2001

(65) Prior Publication Data

US 2001/0010219 A1 Aug. 2, 2001

(51) Int. Cl.[7] ..... F02M 1/00; F02M 33/02
(52) U.S. Cl. ..... 123/520; 123/516
(58) Field of Search ..... 123/520, 198 D, 123/519, 518, 516; 73/118.1

(56) References Cited

U.S. PATENT DOCUMENTS 5,363,828 A * 11/1994 Yamashita et al. ..... 123/520
5,448,980 A * 9/1995 Kawamura et al. ..... 123/520
5,732,687 A * 3/1998 Hashimoto et al. ..... 123/520
5,746,191 A * 5/1998 Isobe et al. ..... 123/686
5,765,539 A * 6/1998 Isobe et al. ..... 123/520
5,775,307 A * 7/1998 Isobe et al. ..... 123/520
6,213,102 B1 * 4/2001 Isobe et al. ..... 123/520

* cited by examiner

*Primary Examiner*—Willis R. Wolfe
*Assistant Examiner*—Mahmoud Gimie
(74) *Attorney, Agent, or Firm*—Arent Fox Kintner Plotkin & Kahn

(57) ABSTRACT

When a leakage fault occurs in the evaporated fuel processing system of a fuel tank, a control system reliably prevents leakage of the evaporated fuel from the point where the leakage fault has occurred. The fuel tank and a canister are connected to each other via a charge passage having a bypass valve, and the canister and an intake passage of an engine are connected to each other via a purge passage having a purge control valve. When a leakage fault occurs in the fuel tank (or the charge passage upstream of the bypass valve), the bypass valve and the purge control valve are opened and an atmosphere release control valve provided on the canister, is closed. The closure of the atmosphere release control valve stops the negative intake pressure of the engine from being consumed by the intake of air through the atmosphere release control valve, and thus it is possible to efficiently prevent the evaporated fuel from leaking from the point where the leakage fault has occurred by effectively transmitting the negative intake pressure to the point where the leakage fault has occurred.

3 Claims, 5 Drawing Sheets

EVAPORATED FUEL PROCESSING SYSTEM

BACKGROUND OF THE INVENTION

1. Field of the Invention

The present invention relates to evaporated fuel processing systems in which a canister is charged with evaporated fuel generated in the fuel tank via a charge passage and the evaporated fuel purged from the canister is supplied to the intake passage of an engine via a purge passage.

2. Description of the Prior Art

An evaporated fuel processing system is provided in order to prevent evaporated fuel generated in the fuel tank of an automobile from diffusing into the atmosphere. The evaporated fuel processing system comprises a canister containing active carbon, which can be charged with and purged of the evaporated fuel. The fuel tank and the canister are connected to each other via a charge passage, and the evaporated fuel generated in the fuel tank is supplied to the canister via the charge passage and adsorbed by the active carbon. The canister is also connected to the intake passage of the engine via a purge passage, the fuel which has been adsorbed by the active carbon is purged by air which is taken into the canister through an atmosphere connection hole by means of the negative intake pressure, and the purged evaporated fuel is supplied to the intake passage of the engine via the purge passage.

Japanese Patent Application Laid-open No. 6-185420 discloses such an evaporated fuel processing system in which, after a pathway from the fuel tank to the intake passage of the engine has been depressurized by the negative intake pressure, a charge control valve provided in the charge passage is closed to seal the fuel tank (and the charge passage upstream of the charge control valve) at a reduced pressure, and detection of a leakage fault is attempted by monitoring changes in the internal pressure of the fuel tank thereafter. When a leakage fault is detected as an increase in the internal pressure of the fuel tank, both the charge control valve and the purge control valve are opened and the evaporated fuel within the fuel tank is sucked into the intake passage of the engine by means of the negative intake pressure to thereby prevent the evaporated fuel from diffusing into the atmosphere from the point where the leakage fault has occurred.

However, in the prior art, when a leakage fault is detected and the evaporated fuel within the fuel tank is sucked into the intake passage of the engine by means of the negative intake pressure, the atmosphere release control valve for opening and closing the atmosphere communication hole of the canister which is positioned between the fuel tank and the intake passage of the engine, is maintained in an open state. Therefore, the negative intake pressure of the engine is consumed by the intake of air from the atmosphere release control valve of the canister, and the negative intake pressure of the engine cannot be transmitted effectively to the point where the leakage fault has occurred, which is upstream of the atmosphere release control valve of the canister. As a result it is difficult to completely prevent the evaporated fuel from leaking from the point where the leakage fault has occurred.

SUMMARY OF THE INVENTION

The present invention has been conducted in view of the above mentioned circumstances, and when a leakage fault occurs in the evaporated fuel processing system of a fuel tank, it is an object of the present invention to reliably prevent the evaporated fuel from leaking from the point where the leakage fault has occurred.

In order to achieve the above-mentioned objective, in accordance with the present invention, an evaporated fuel processing system is proposed which comprises a fuel tank for holding fuel, a canister which can be charged with and purged of evaporated fuel, a charge control valve for opening and closing a charge passage which connects the fuel tank to the canister, a purge control valve for opening and closing a purge passage which connects the canister to an intake passage of an engine, and an atmosphere release control valve for opening and closing an atmosphere communication hole of the canister. A control means is provided which detects a leakage fault in the fuel tank or the charge passage upstream of the charge control valve, and when a leakage fault is detected the control means opens the charge control valve and the purge control valve and closes the atmosphere release control valve.

In accordance with the above-mentioned system, when a leakage fault is detected the charge control valve and the purge control valve are opened to transmit the negative intake pressure of the intake passage of the engine to the point where the leakage fault has occurred, the evaporated fuel is sucked into the intake passage of the engine by means of the negative intake pressure, and thus leakage from the point where the leakage fault has occurred can be prevented. Since the atmosphere release control valve of the canister is maintained in a closed state during this period, the negative intake pressure of the engine cannot be consumed by the intake of air from the atmosphere release control valve, and the negative intake pressure of the engine can be transmitted efficiently to the point where the leakage fault has occurred to effectively prevent the evaporated fuel from leaking from the point where the leakage fault has occurred.

Furthermore, an evaporated fuel processing system according to the present invention comprises a pressure detecting means for detecting the internal pressure of the fuel tank or the charge passage upstream of the charge control valve, and when the amount of leakage detected by the control means is less than or equal to a predetermined value, the control means controls the degree of opening of the purge control valve on the basis of the pressure detected by the pressure detecting means such that the internal pressure of the fuel tank becomes slightly negative.

In accordance with the above-mentioned system, since in the case where the amount of leakage is not more than a predetermined value the degree of opening of the purge control valve is controlled on the basis of the pressure detected by the pressure detecting means so that the internal pressure of the fuel tank is slightly negative. Thus the amount of evaporated fuel sucked into the intake passage of the engine can be minimized while at the same time preventing the leakage of evaporated fuel from the point where the leakage has occurred, and the time required for the canister to become fully charged can thus be extended.

Furthermore, an evaporated fuel processing system according to the present invention comprises a pressure detecting means for detecting the internal pressure of the fuel tank or the charge passage upstream of the charge control valve, and when the control means detects an open failure of the charge control valve, the control means controls the degree of opening of the purge control valve on the basis of the pressure detected by the pressure detecting means such that the internal pressure of the fuel tank becomes slightly negative.

In accordance with the above-mentioned system, where there is an open failure in the charge control valve, the degree of opening of the purge control valve is controlled on the basis of the pressure detected by the pressure detecting means. Thus the internal pressure of the fuel tank becomes slightly negative, and the time required for the canister to become fully charged due to the additional supply of evaporated fuel from within the fuel tank to the canister can be extended.

BRIEF DESCRIPTION OF THE DRAWINGS

FIG. 1 is a diagram showing the entire structure of an evaporated fuel processing system in the case of a large leakage.

FIG. 2 is a diagram showing the entire structure of an evaporated fuel processing system in the case of a small leakage.

FIG. 3 is a diagram for explaining a method of detecting a leakage fault and a method of detecting a failure in the opening of the charge control valve.

FIG. 4 is a flow chart of the main routine of the present invention.

FIG. 5 is a flow chart of a purge control routine which makes the internal pressure of the tank negative.

DETAILED DESCRIPTION OF THE PREFERRED EMBODIMENT

Figure 1:
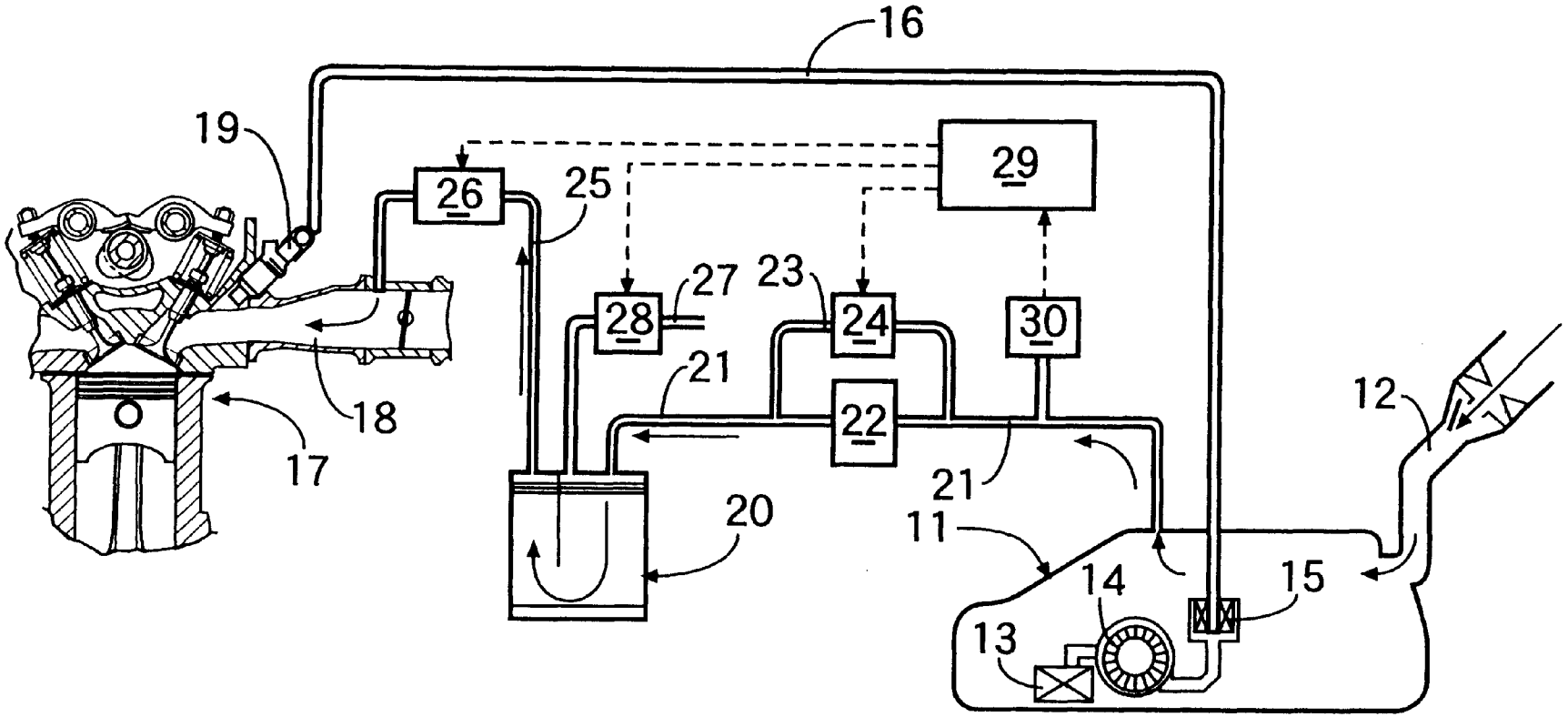
FIG. 1 to FIG. 5 illustrate an embodiment of the present invention.
Figure 2:
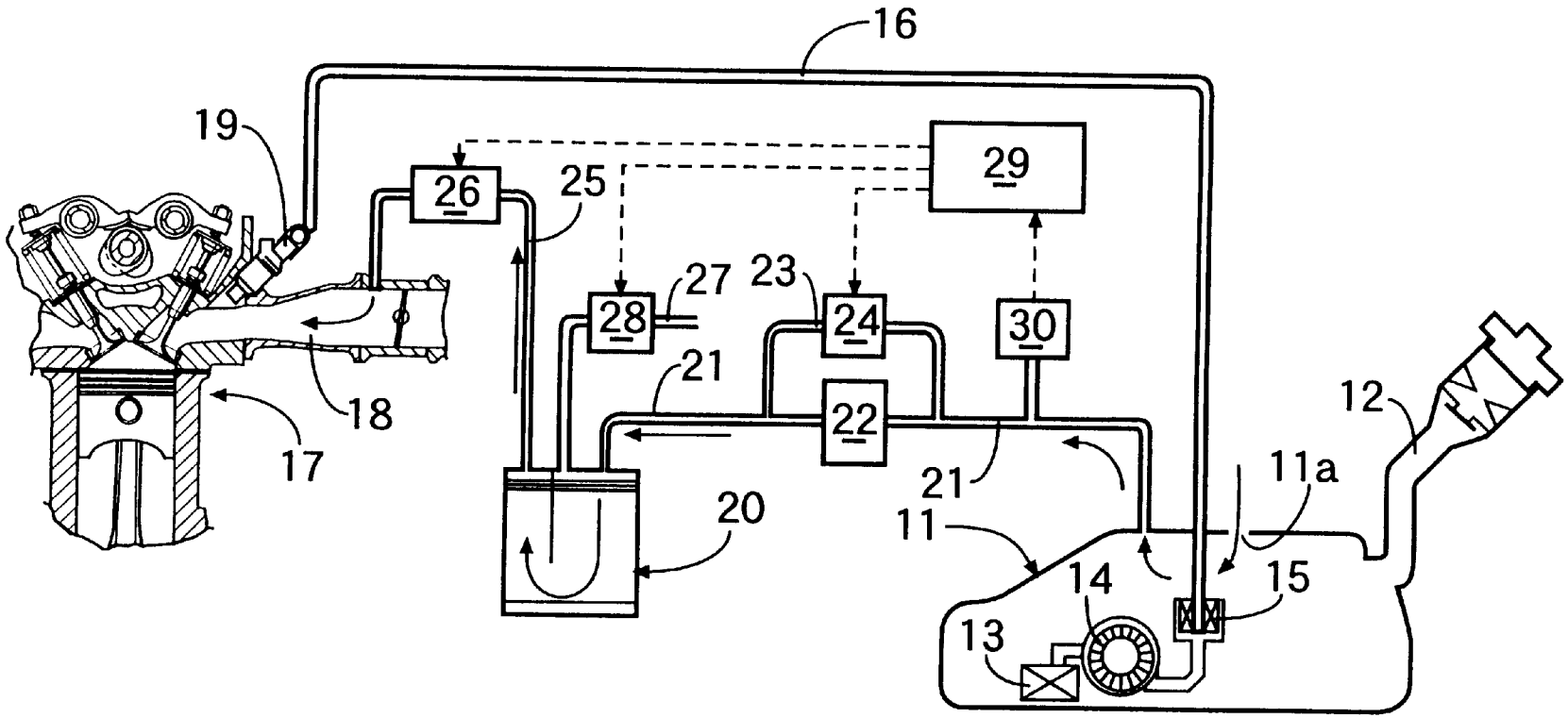

As shown in FIG. 1 and FIG. 2, a fuel tank 11 for an automobile comprises a filler tube 12 for supplying fuel from a fuel supply gun of a gasoline pump (not illustrated). A strainer 13, a fuel pump 14 and a filter 15 are provided inside the fuel tank 11, and fuel which has passed the filter 15 is supplied to an injector 19 provided on an intake passage 18 of an engine 17 via a feed pipe 16.

A canister 20 inside which is stored active carbon and which can be charged with and purged of the evaporated fuel, is connected to the fuel tank 11 via a charge passage 21, and a known two-way valve 22 which is formed by connecting two relief valves to each other in parallel and in opposite directions is positioned in the midsection of the charge passage 21. In a bypass passage 23 which is connected to the both ends of the two-way valve 22, there is provided a bypass valve 24 which corresponds to a charge control valve, comprising an ON/OFF solenoid valve for opening and closing the bypass passage 23. A purge passage 25 which connects the canister 20 to the intake passage 18 of the engine 17, is provided with a purge control valve 26 comprising a linear solenoid valve which can control the degree of opening in a stepless manner. Furthermore, an atmosphere communication hole 27 of the canister 20 is provided with an atmosphere release control valve 28 comprising an ON/OFF solenoid valve for opening and closing the atmosphere communication hole 27.

A pressure detecting means 30 for detecting a pressure difference from atmospheric pressure, which is provided on the charge passage 21 between the fuel tank 11 and the upstream side of the bypass valve 24, detects the internal pressure of the tank which is input into a control means 29 comprising a microcomputer. The control means 29 controls the opening and closing of the bypass valve 24 and the atmosphere release control valve 28 on the basis of the internal pressure of the tank detected by the pressure detecting means 30 and also controls the degree of opening of the purge control valve 26.

Next, the action of the evaporated fuel processing system during usual operation (normal operation) is explained.

The bypass valve 24 and the purge control valve 26 are normally closed and the atmosphere release control valve 28 is normally open. When the temperature of the fuel tank 11 increases while the engine 17 is not running so as to increase the internal pressure, the positive pressure valve of the two-way valve 22 opens due to the internal pressure, the evaporated fuel generated within the fuel tank 11 and the expanded air are supplied to the canister 20. The evaporated fuel is adsorbed by the active carbon inside the canister 20, and the air alone is discharged through the atmosphere release control valve 28. Thus it is possible to prevent the evaporated fuel from diffusing into the atmosphere as well as prevent the internal pressure of the fuel tank 11 from increasing excessively.

When the temperature of the fuel tank 11 decreases while the engine 17 is not running to thereby decrease the internal pressure, the negative pressure valve of the two-way valve 22 opens due to the difference in pressure from atmospheric pressure and air introduced through the atmosphere release control valve 28 is supplied to the fuel tank 11. It is thus possible to prevent the fuel tank 11 from being distorted by the negative pressure.

Furthermore, the bypass valve 24 is opened to connect the fuel tank 11 to the atmosphere communication hole 27 prior to feeding fuel to the fuel tank 11. Thus, even if the internal pressure of the fuel tank 11 is positive at this stage it can be reduced to atmospheric pressure, and it is possible to prevent evaporated fuel from diffusing into the atmosphere through the fuel inlet of the filler tube 12.

Moreover, by opening the purge control valve 26 regularly during operation of the engine 17 to connect the canister 20 to the intake passage 18 of the engine 17, the fuel with which the canister 20 has been charged can be purged by air taken in through the atmosphere communication hole 27 and the purged evaporated fuel can be supplied to the intake passage 18 of the engine 17.

Figure 3:
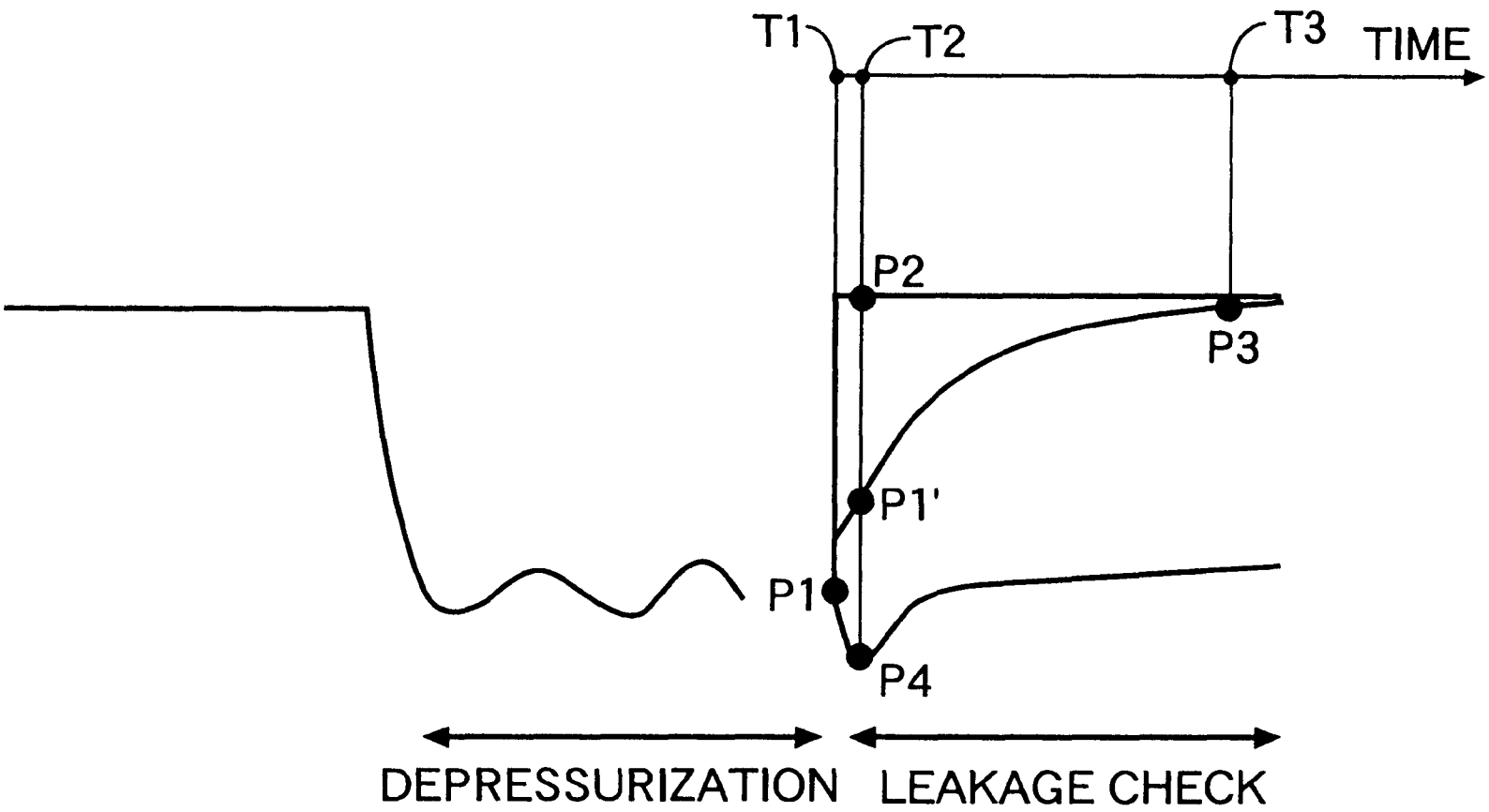

Next, the method of detecting a leakage fault of the fuel tank 11 (including a leakage fault in the charge passage 21 upstream of the bypass valve 24) by means of the control means 29 and the method of detecting an open failure of the bypass valve 24 are explained by reference to FIG. 3.

Checking for detection of a leakage fault is carried out periodically while the vehicle is travelling. Both the purge control valve 26 in the purge passage 25 and the bypass valve 24 in the charge passage 21 are opened while closing the atmosphere release control valve 28 of the canister 20. As a result, the interior of the fuel tank 11, the interior of the purge passage 25 and the interior of the charge passage 21 are depressurized by means of the negative intake pressure generated in the intake passage 18 of the engine 17. When the bypass valve 24 is closed in this state, the interior of the charge passage 21 between the bypass valve 24 and the fuel tank 11 and the interior of the fuel tank 11 are sealed in a state in which they are depressurized at a pressure level P1. Since the pressure required for opening the negative pressure valve of the two-way valve 22 is lower than this level, the negative pressure valve is maintained in a closed state and the depressurization is not disturbed by the two-way valve 22.

Changes in the pressure of the charge passage 21 are monitored over time by means of the pressure detecting means 30. More particularly, after the bypass valve 24 is closed at time T1, the pressure is detected at time T2 after a comparatively short time, and the pressure is detected again at time T3 after a comparatively long time.

As a result, if the pressure which is P1 at time T1, rapidly increases to P2 at time T2 and then remains unchanged until time T3, that is to say, if the difference (P2–P1) between P2 and P1 is not less than a predetermined threshold value, it is determined that there is a large leakage. A large leakage could be caused, for example, by the cap of the filler tube 12 of the fuel tank 11 dropping off to thereby connect the fuel tank 11 to the atmosphere as shown in FIG. 1.

If the pressure which is P1 at time T1, slightly increases to P1' at time T2 and then slowly increases to P3 at time T3 after a comparatively long time, that is to say, if the difference (P3–P1') between P3 and P1' is not less than a predetermined threshold value, it is determined that there is a small leakage. A small leakage could be caused, for example, by a tiny hole 11 a being formed in the fuel tank 11 as shown in FIG. 2.

If the pressure which is P1 at time T1, decreases to P4 at time T2, it is determined that an open failure has occurred in the bypass valve 24 (a failure due to it sticking in the open state). This is because if the bypass valve 24 is closed correctly when its closure is attempted at time T1, since the negative intake pressure of the engine 17 is blocked, the pressure should not decrease further.

Figure 4:
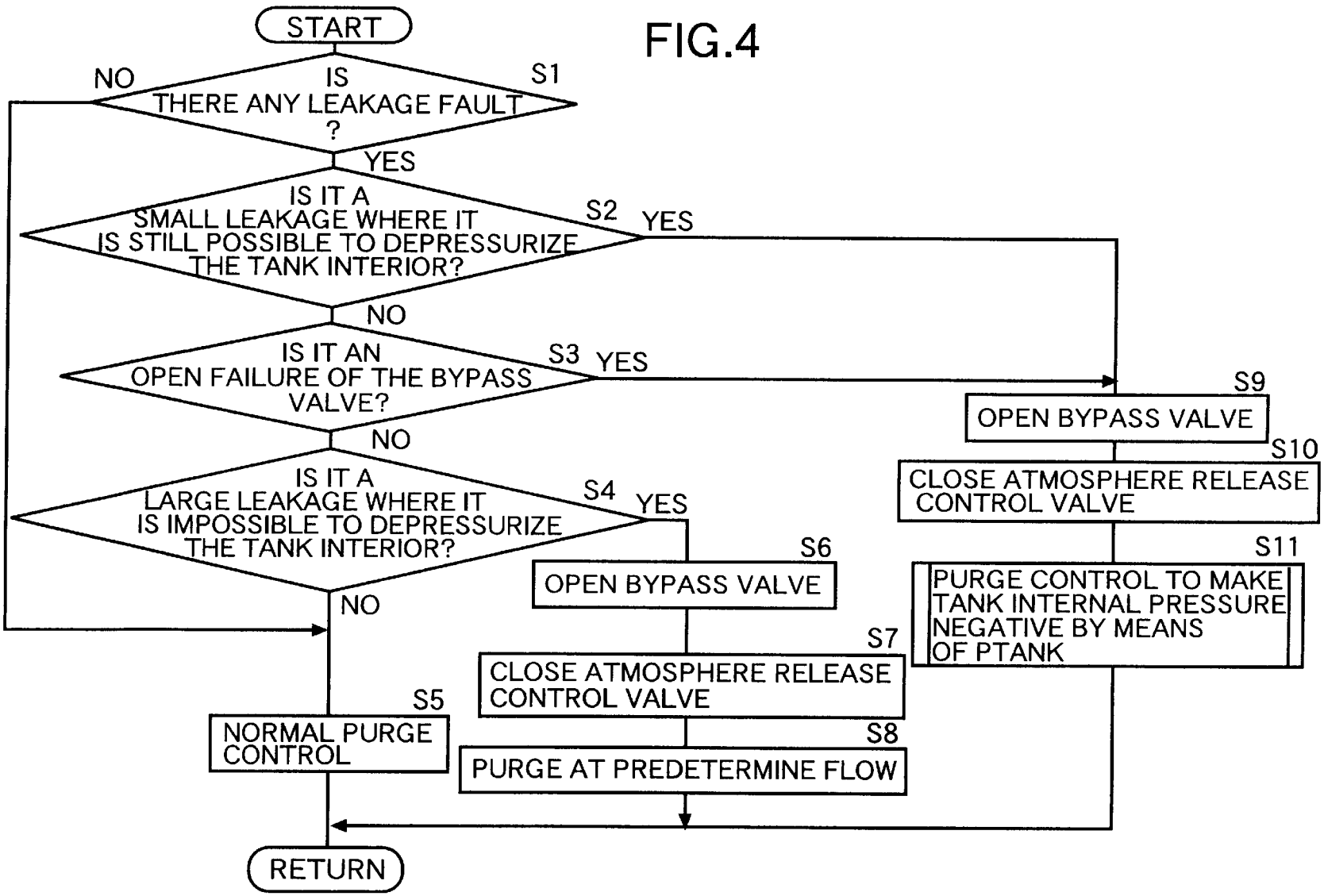

Next, the control process which is carried out when a leakage fault occurs is explained by reference to the flow chart shown in FIG. 4.

Firstly, in Step S1 a determination is made as to whether or not any abnormality (large leakage, small leakage or open failure of the bypass valve 24) has occurred. If there is no abnormality, the routine moves on to Step S5 and the normal purge control is carried out. If there is some abnormality in Step S1, in Step S2 it is determined whether the abnormality is a small leakage, in Step S3 it is determined whether the abnormality is an open failure of the bypass valve 24 and in Step S4 it is determined whether the abnormality is a large leakage, and the routine then moves on to Step S6 to Step S8. Even in the case where it is decided in Step Si that there is some abnormality, if all the determinations in Step S2 to Step S4 are 'NO', a normal purge control is carried out in Step S5.

When a determination is made that there is a large leakage in Step S4, the bypass valve 24 is opened in Step S6 and the atmosphere release control valve 28 is closed in Step S7. As a result, in Step S8 the air which has been sucked from the point where the large leakage has occurred (for example, the filler tube 12 from which the cap has dropped off) is taken into the intake passage 18 of the engine 17 through the charge passage 21 in which the bypass valve 24 is fully opened, the canister 20 and the purge passage 25 in which the purge control valve 26 is fully opened, and thus the evaporated fuel is prevented from diffusing into the atmosphere through the point where the large leakage has occurred. At this stage since the atmosphere release control valve 28 provided on the atmosphere communication hole 27 of the canister 20, is closed, air is prevented from entering via the atmosphere communication hole 27 and the canister 20, and it is possible to suppress diffusion of the evaporated fuel into the atmosphere to a minimum level by taking in the maximum level of air from the point where the large leakage has occurred.

On the other hand, when a determination is made in Step S2 that there is a small leakage, in Step S9 the bypass valve 24 is opened, in Step S10 the atmosphere release control valve 28 is closed, and further in Step S11 the degree of opening of the purge control valve 26 provided on the purge passage 25, is controlled to make the gauge pressure in the vicinity of the point where the small leakage has occurred (for example, the small hole 11 a of the fuel tank 11) slightly negative thereby preventing the evaporated fuel from diffusing into the atmosphere.

Also in the case where there is an open failure of the bypass valve 24 in Step S3, Steps S9 to S11 are carried out and the degree of opening of the purge control valve 26 is appropriately controlled. Thus, the evaporated fuel within the fuel tank 11 is prevented from being supplied excessively to the canister 20 through the bypass valve 24 in which there is an open failure, and it is possible to delay the canister 20 from becoming fully charged.

If a leakage fault or an open failure of the bypass valve 24 is detected, the driver is alerted of the need for a repair.

Figure 5:
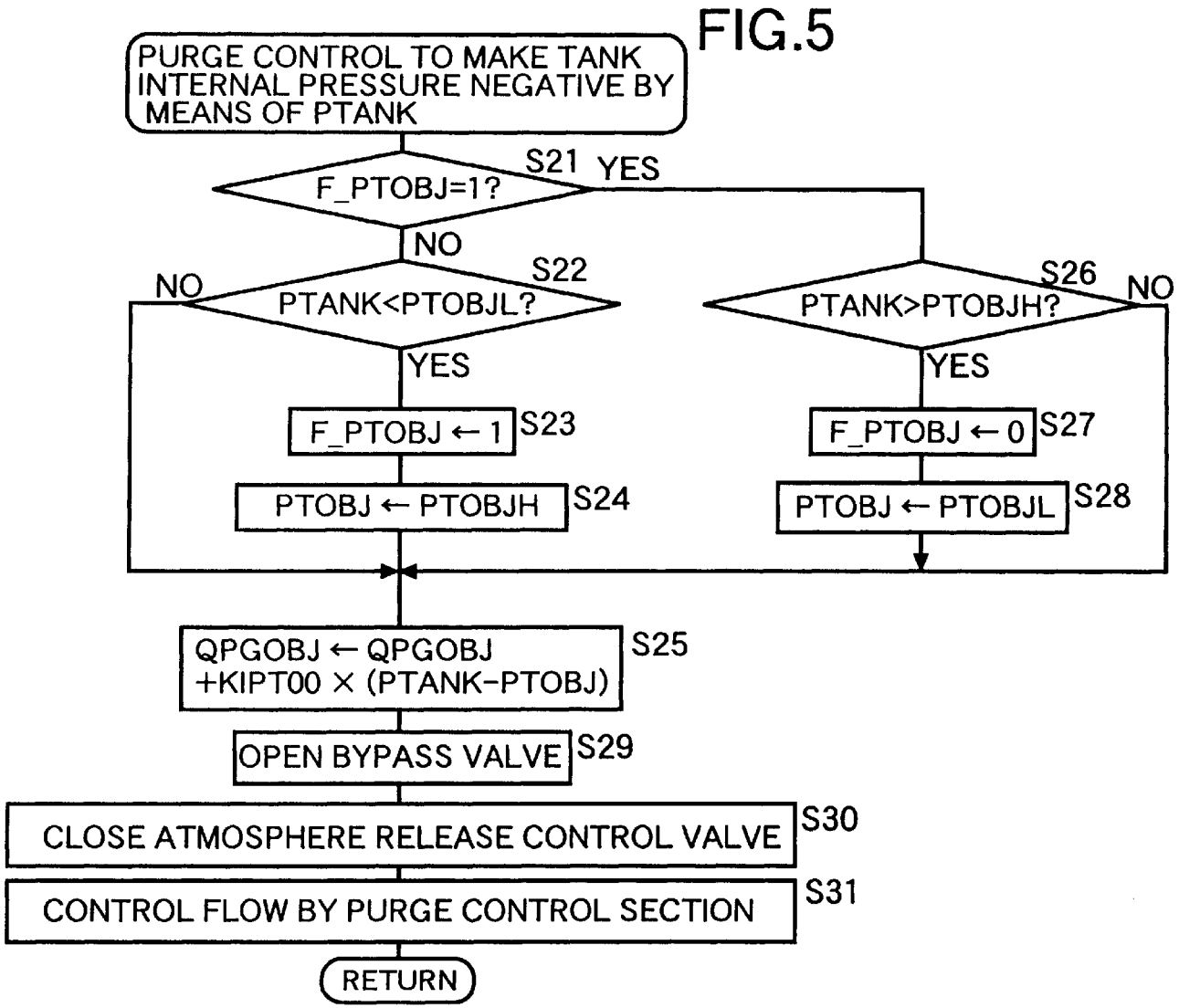

Next, the contents of Step S11 are explained in detail by reference to the flow chart shown in FIG. 5.

Firstly, the state of the tank internal pressure determination flag F_PTOBJ is determined in Step S21. When the tank internal pressure determination flag F_PTOBJ is, '1' the internal pressure of the tank is lower than a target value, and when the tank internal pressure determination flag F_PTOBJ is '0', the internal pressure of the tank is higher than the target value.

If the tank internal pressure determination flag F_PTOBJ is '0' in Step S21 and the internal pressure of the fuel tank is higher than the target value, in Step S22 the actual tank internal pressure PTANK (the pressure detected by the pressure detecting means 30) is compared with a predetermined tank internal pressure lower limit PTOBJL. If the actual tank internal pressure PTANK is less than the tank internal pressure lower limit PTOBJL, in Step S23 the tank internal pressure determination flag F_PTOBJ is set to '1' which indicates low pressure and in Step S24 the predetermined tank internal pressure upper limit PTOBJH is made the target tank internal pressure PTOBJ.

Therefore, if the actual tank internal pressure PTANK is not less than the tank internal pressure lower limit PTOBJL in Step S22, in Step S25 the tank internal pressure lower limit PTOBJL is used as the target tank internal pressure PTOBJ. If the actual tank internal pressure PTANK is less than the tank internal pressure lower limit PTOBJL in Step S22, in Step S25 the tank internal pressure upper limit PTOBJH is used as the target tank internal pressure PTOBJ.

On the other hand, if the tank internal pressure determination flag F_PTOBJ is '1' in Step S21 and the internal pressure of the fuel tank is lower than the target value, in Step S26 the actual tank internal pressure PTANK (the pressure detected by the pressure detecting means 30) is compared with the predetermined tank internal pressure upper limit PTOBJH. If the actual tank internal pressure PTANK exceeds the tank internal pressure upper limit PTOBJH, in Step S27 the tank internal pressure determination flag F_PTOBJ is set to '0' which indicates high pressure and in Step S28 the predetermined tank internal pressure lower limit PTOBJL is made the target tank internal pressure PTOBJ.

Therefore, if the actual tank internal pressure PTANK does not exceed the tank internal pressure upper limit PTOBJH in Step S26, in Step S25 the tank internal pressure upper limit PTOBJH is used as the target tank internal pressure PTOBJ. If the actual tank internal pressure PTANK exceeds the tank internal pressure lower limit PTOBJL in Step S26, in Step S25 the tank internal pressure lower limit PTOBJL is used as the target tank internal pressure PTOBJ.

When the target tank internal pressure PTOBJ has thus been determined on the basis of the actual tank internal pressure PTANK, the degree of opening of the purge control valve 26, that is, the target flow QPGOBJ is calculated in Step S25. In detail, the value which is obtained by multiplying the deviation of the actual tank internal pressure PTANK from the target internal pressure PTOBJ by a factor KIPTOO is added to the previous value for the target flow QPGOBJ to give the current value for the target flow QPGOBJ. The tank internal pressure upper limit PTOBJH is, for example, −930 Pa, and the tank internal pressure lower limit PTOBJL is, for example, −1330 Pa.

In the subsequent Step S29 the degree of opening of the purge control valve 26 is determined to obtain the target flow QPGOBJ, and in Step S30 the atmosphere release control valve 28 is closed. As a result, the pressure detected by the pressure detecting means 30 is controlled to be in the vicinity of −670 Pa by the negative pressure of the intake passage 18 of the engine 17, and this negative pressure works on the point where the small leakage has occurred to prevent the evaporated fuel from diffusing into the atmosphere. Furthermore, in the case where an open failure occurs in the bypass valve 24, it is possible to delay the canister 20 from becoming fully charged due to excess supply of evaporated fuel to canister 20 by extracting the evaporated fuel from within the fuel tank 11 by means of a small degree of negative pressure of about −670 Pa.

In addition, since the canister 20 would become fully charged if the control process which is carried out when a leakage fault has occurred, that is, the control process which opens the purge control valve 26 and the bypass valve 24 while closing the atmosphere release control valve 28, is continued over a long period, the control process is periodically switched over to purge control to purge the fuel within the fully charged canister 20 into the intake passage 18 of the engine 17. That is, the bypass valve 24 is closed, the atmosphere release control valve 28 is opened and the purge control valve 26 is fully opened to suck air into the canister 20 through the atmosphere communication hole 27, and the fuel with which the canister 20 has been charged is purged by means of the air.

The pressure detecting means 30 is provided on the charge passage 21 upstream of the bypass valve 24 in the embodiment described above, but the pressure detecting means 30 may be provided directly on the fuel tank 11.

In accordance with the present invention, when a leakage fault is detected the charge control valve and the purge control valve are opened to transmit the negative intake pressure of the intake passage of the engine to the point where the leakage fault has occurred. The evaporated fuel is sucked into the intake passage of the engine by means of the negative intake pressure, and thus leakage from the point where the leakage fault has occurred can be prevented. Since the atmosphere release control valve of the canister is maintained in a closed state during this period, the negative intake pressure of the engine cannot be consumed by the intake of air from the atmosphere release control valve, and the negative intake pressure of the engine can be transmitted efficiently to the point where the leakage fault has occurred to effectively prevent the evaporated fuel from leaking from the point where the leakage fault has occurred.

In the case where the amount of leakage is not more than a predetermined value, the degree of opening of the purge control valve is controlled on the basis of the pressure detected by the pressure detecting means so that the internal pressure of the fuel tank is slightly negative. The amount of evaporated fuel sucked into the intake passage of the engine can be minimized while at the same time preventing the leakage of evaporated fuel from the point where the leakage has occurred, and the time required for the canister to become fully charged can thus be extended.

In the case where there is a failure in the opening of the charge control valve, the degree of opening of the purge control valve is controlled on the basis of the pressure detected by the pressure detecting means so that the internal pressure of the fuel tank becomes slightly negative, and the time required for the canister to become fully charged due to the additional supply of evaporated fuel from within the fuel tank to the canister can be extended.

The present invention may be embodied in other specific forms without departing from the spirit or essential characteristics thereof. The presently disclosed embodiment is therefore to be considered in all respects as illustrative and not restrictive, the scope of the invention being indicated by the appended claims, rather than the foregoing description, and all changes which come within the meaning and range of equivalency of the claims are, therefore, to be embraced therein.

What is claimed is:

1. An evaporated fuel processing system for an engine having an intake passage, the system comprising:

a fuel tank for holding fuel;

a canister adapted to be charged with and purged of evaporated fuel;

a charge passage for connecting the fuel tank and the canister;

a charge control valve for opening and closing the charge passage connecting the fuel tank and the canister;

a purge passage for connecting the canister and the intake passage of the engine;

a purge control valve for opening and closing the purge passage connecting the canister and the intake passage of the engine; and an atmosphere release control valve for opening and closing an atmosphere communication hole of the canister; and a control means for detecting a leakage fault in the fuel tank or the charge passage upstream of the charge control valve;

wherein when a leakage fault is detected the control means opens the charge control valve and the purge control valve and closes the atmosphere release control valve.

2. An evaporated fuel processing system according to claim 1, including a pressure detecting means for detecting the internal pressure of the fuel tank or the charge passage upstream of the charge control valve, wherein when the amount of leakage detected by the control means is less than or equal to a predetermined value, the control means controls the degree of opening of the purge control valve on the basis of the pressure detected by the pressure detecting means, such that the internal pressure of the fuel tank becomes negative.

3. An evaporated fuel processing system according to claim 1, including a pressure detecting means for detecting the internal pressure of the fuel tank or the charge passage upstream of the charge control valve, wherein when the control means detects an open failure of the charge control valve, the control means controls the degree of opening of the purge control valve on the basis of the pressure detected by the pressure detecting means such that the internal pressure of the fuel tank becomes negative.

* * * * *